US007384079B2

(12) United States Patent
Bantle et al.

(10) Patent No.: US 7,384,079 B2
(45) Date of Patent: Jun. 10, 2008

(54) LOCK

(75) Inventors: Ulrich Bantle, Empfingen (DE); Jürgen Eschle, Aichhalden (DE)

(73) Assignee: Karl Simon GmbH & Co. KG, Aichhalden (DE)

( * ) Notice: Subject to any disclaimer, the term of this patent is extended or adjusted under 35 U.S.C. 154(b) by 0 days.

(21) Appl. No.: 10/580,182

(22) PCT Filed: Mar. 15, 2004

(86) PCT No.: PCT/EP2004/002669

§ 371 (c)(1),
(2), (4) Date: May 22, 2006

(87) PCT Pub. No.: WO2005/052291

PCT Pub. Date: Jun. 9, 2005

(65) Prior Publication Data

US 2007/0080545 A1 Apr. 12, 2007

(30) Foreign Application Priority Data

Nov. 21, 2003 (DE) ..... 103 61 929

(51) Int. Cl.
*E05C 1/06* (2006.01)

(52) U.S. Cl. ..... 292/36; 292/41

(58) Field of Classification Search ..... 292/34, 292/27, 37, 46, 26, 36, 48, 41
See application file for complete search history.

(56) References Cited

U.S. PATENT DOCUMENTS 1,934,137 A * 11/1933 Moore ..... 292/47
2,446,735 A * 8/1948 Banliam ..... 292/34
3,596,952 A * 8/1971 Hinkle et al. ..... 292/27
4,538,844 A * 9/1985 Watanabe ..... 292/127
5,484,179 A * 1/1996 Mader ..... 292/336.3
5,551,736 A 9/1996 Fann et al.
6,669,243 B2 * 12/2003 Katoh et al. ..... 292/34
2003/0090113 A1 5/2003 Piorkowski

FOREIGN PATENT DOCUMENTS

| | | | |
|---|---|---|---|
| CH | 200 955 | A | 11/1938 |
| CH | 436 018 | A | 5/1967 |
| DE | 2 240 413 | | 2/1974 |
| DE | 24 10 413 | | 9/1975 |
| DE | 44 40 804 | A | 5/1996 |
| DE | 195 41 944 | C1 | 11/1996 |
| FR | 2 199 791 | A | 4/1974 |
| GB | 527 971 | A | 10/1940 |
| GB | 626 302 | A | 7/1949 |
| GB | 1 554 731 | A | 10/1979 |

* cited by examiner

*Primary Examiner*—Gary Estremsky
(74) *Attorney, Agent, or Firm*—Pauley Petersen & Erickson

(57) ABSTRACT

A lock which can be used for doors which are fitted on the right or left. The lock includes a nut which can be adjusted from the outside by an actuating element and which is disposed in a housing. The lock enables a bolt to be displaced between a closed position, when it is pushed out from the housing, and an open position, when it is pushed into the housing, by an adjusting element. According to this invention, the bolt is maintained in a closed position, counter to the pretension of a spring, in order to enable the type of lock, which can be optionally used on the left or on the right, to be produced without any additional costs. The nut can be adjusted from the pushed out bolt or the closed position, optionally, in a clockwise direction or in an counter-clockwise direction, in order to move the bolt into an open position.

10 Claims, 3 Drawing Sheets

LOCK

BACKGROUND OF THE INVENTION

1. Field of the Invention

This invention relates to a lock which can be used for doors hinged on the right or the left, having a follower contained in a housing and which can be displaced from the outside by an actuating element, by which a bolt can be moved by a displacement member between a locking position, in which it is pushed out of the housing, and an opened position, in which it is pushed into the housing.

2. Discussion of Related Art

A lock is known from German Patent Reference DE 195 41 944 C1.

A displaceable blocking element is used in connection with this lock and can be shifted so that the direction of rotation of the follower can be reversed depending on whether it is used in a left or right operation. Thus a user can set the lock prior to being mounted as a function of the selected way in which it is hinged.

Furthermore, spring locks are known and have a bolt which can be adjusted against the pre-stressing of a spring.

SUMMARY OF THE INVENTION

It is one object of this invention to provide a lock of the type mentioned above but which can be used for either left hinging or right hinging without an additional adjustment of a cost outlay.

This object is attained when a bolt is maintained in the locking position against the prestress by a spring and when the follower can be selectively adjusted in a clockwise or counterclockwise direction when the bolt is pushed out, in a locked position, in order to put the bolt into the opened position. In accordance with this invention, the known spring lock principle is transferred to a lock which is usable left or right. In the process, the association between the follower and the bolt is such that the follower can be rotated in a clockwise direction as well as in a counterclockwise direction for placing the bolt into the opened position. Thus it is possible to install the lock without an additional cost outlay for use on the left as well as on the right.

In accordance with one embodiment of this invention, the displacement member of the follower has two actuating members resting against respective control cams of the bolt and which are supported there under prestress by a spring in the locked position of the bolt. The follower, or the actuation members, can be maintained in a predetermined initial position by the spring. Thus it is possible to maintain the follower in a defined initial position when the bolt is in the locking position. A handle coupled with the follower is then also maintained in an initial position. In addition, an adjustment free of play of the bolt is achieved with little structural cost outlay by using the prestress of the spring.

Thus the spring maintains the bolt in its prestressed position against the actuating members used as stops. The spring has a double function. It is used for supporting the bolt. The follower can be maintained in its initial position by the spring.

In order to realize comparable forces and/or displacement properties of the lock, both with left and right hinging, the two control cams can be symmetrically arranged with respect to a plane defined by the extension direction of the bolt and the axis of rotation of the follower. Then the symmetrical lock embodiment also makes possible a simple lock construction. Easy mounting of the lock, in particular one which can be automated, results if the housing has a spring receptacle into which the spring can be inserted in a first prestressed position, and if the bolt has a pusher, which maintains the spring in the second prestress position associated with the locking position.

In one alternative embodiment of this invention, with the bolt pushed into the housing, the follower is supported on a spring element. With the spring the follower can be automatically moved from the opened into the locking position, independently of the bolt.

The functionality of the lock can be extended in a simple manner if the bolt or the follower are directly or indirectly coupled to a bolt arrangement by a revolving rod. Thus it is possible to achieve a low structural cost outlay along with a large degree of dependability if the revolving rod a bolt can be adjusted by a drive element which is coupled with the revolving rod. The bolt is maintained in its locking position in a bolt housing against the prestress by a spring element, and the bolt can be displaced against the spring prestress by the drive element.

The cost outlay for parts can be kept low if the bolt or the follower drives two structurally identical bolt arrangements, each by a revolving rod.

BRIEF DESCRIPTION OF THE DRAWINGS

This invention is explained in greater detail in view of an exemplary embodiment represented in the drawings, wherein.

DETAILED DESCRIPTION OF THE INVENTION

Figure 1:
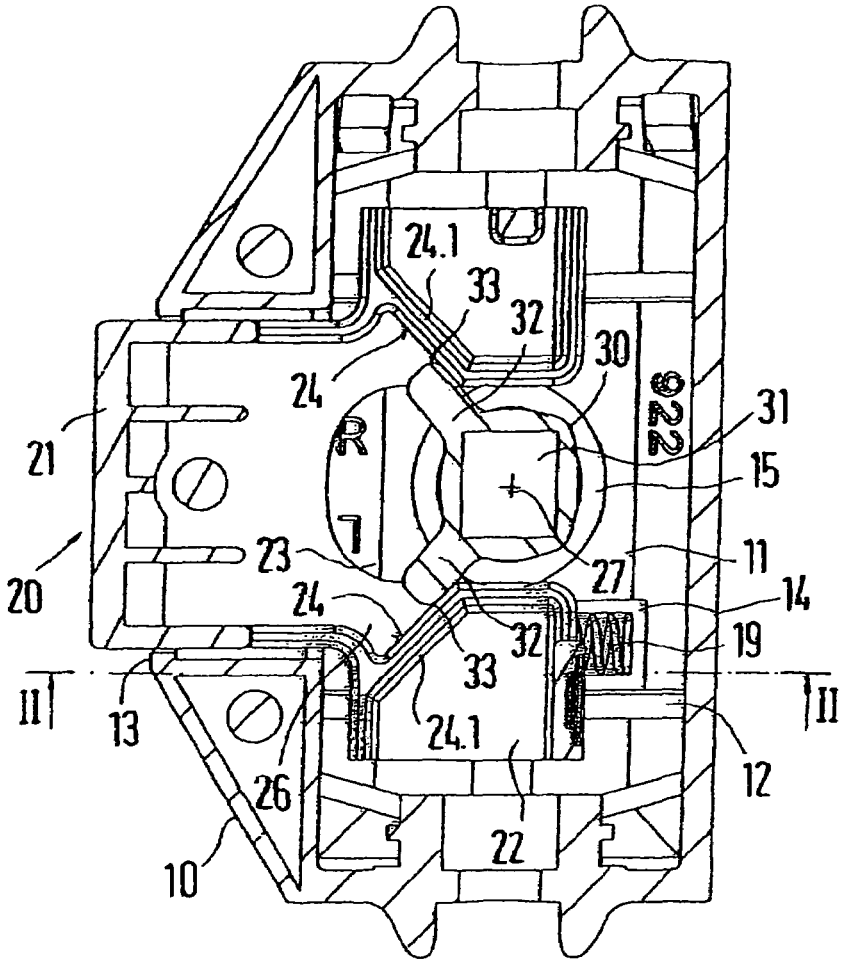
FIG. 1 shows a lock in a rear view, along section line I-I represented in FIG. 2.
Figure 2:
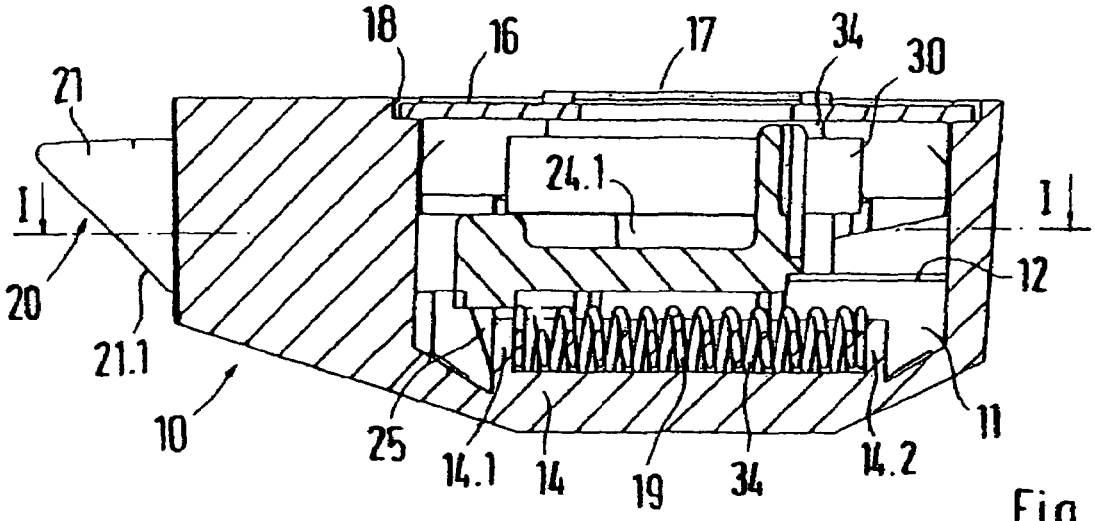
FIG. 2 shows the lock along section line II-II represented in FIG. 1.

A lock is shown in FIG. 1, wherein a bolt 20 is placed into a housing 10. The bolt 20 has a locking tongue 21 which projects through an opening 13 out of the receptacle chamber 11 enclosed by the housing 10. The bolt 20 is seated on two strip-like guide devices 12, which are arranged in the receptacle chamber 11, and the bolt 20 can be displaced on them in the viewing level between an opened position and a locking position. During this, the locking tongue 21 also moves between these positions into the housing 10 or out of the housing 10. As shown in FIG. 2, the bolt 20 is guided in the receptacle chamber 11 between the guide devices 12 and a cover 16, which closes off the receptacle chamber 11. Adjoining the locking tongue 21, the bolt 20 has a base element 26, on which two lateral shoulders 22 are formed. Each one of the shoulders 22 has a strip 24.1, each of which forms a control cam 24.

An actuating member 32 of a follower 30 rests against each one of the control cams 24. The actuating members 32 are designed in the shape of a finger and are formed as one part on the follower 30. The follower 30 is seated in the housing 10 and is rotatable around the axis of rotation 27 shown in FIG. 1. The follower 30 has two bearing shoulders 34 for this purpose, one which is seated in a bearing receiver of the cover 16, and the other which is seated in the bottom of the housing 10. The follower 30 has a square handle receiver 31. A square opening of a handle, not represented in the drawing, can be pushed through an appropriate opening 17 of the cover 16 and connected, for example locked, with the follower 30.

The follower 30 extends with a center element 15 through a hole 23 in the bolt 20. The hole 23 is embodied as an elongated hole, so that the follower 30 does not interfere with the displacement of the bolt 20 between the opened position and the locking position. However, in these end positions the center element 15 limits the displacement of the bolt 20 because it comes to rest against the ends of the elongated hole. As FIG. 1 shows, the follower 30 is designed symmetrically in relation to the plane enclosed by the axis of rotation 27 and the displacement direction of the bolt 20. Similarly, the control cams 24 are arranged symmetrically with respect to this plane.

As FIG. 2 shows, a spring receptacle 14 is formed in the area of or near the bottom of the housing 10. A spring 19, in this case a helical spring, is placed into the receptacle. The spring 19 is maintained in a first prestressed position between two spring detents 14.1. The bolt 20 has a pusher 25, which extends through an opening in the facing spring detent 14.1 and is in contact with the front face of the spring 19. In the process, the spring 19 prestresses the bolt 20 by the pusher 25. Thus, the follower 30 is maintained prestressed against its actuating members 32 by the control cams 24.1. By using the handle, not represented, the follower 30 can be rotated in a clockwise or a counterclockwise direction from its initial position, which is represented in FIG. 1, associated with the locking position of the lock. During a rotation of the follower 30, the respective actuating member 32 slides up on the associated control cam 24.1. A rounded-off end 33 protects the control cam 24.1. The bolt 20 is pulled into the housing 10 by the actuating member 32. During the bolt displacement, the bolt 20 prestresses the spring 19 by its pusher 25. When the center element 15 comes to rest against the end of the elongated hole-like opening 23, the bolt 20 is in the opened position.

The bolt 20 can again be brought into the locking position when the handle of the follower 30 is released. The spring 19 then pushes the bolt 20 back. During this, the follower 30 is simultaneously returned into its initial position.

The lock is designed as a spring lock. Accordingly, the locking tongue 21 can be deflected at a latch bolt by an oblique deflection element 21.1. The bolt 20 is then pushed into the housing 10 against the force of the spring 19. So that the follower 30 does not take up an undefined position, an additional spring element, not represented in the drawing, maintains the follower 30 prestressed, such as in the initial position represented in FIG. 1.

Figure 3:
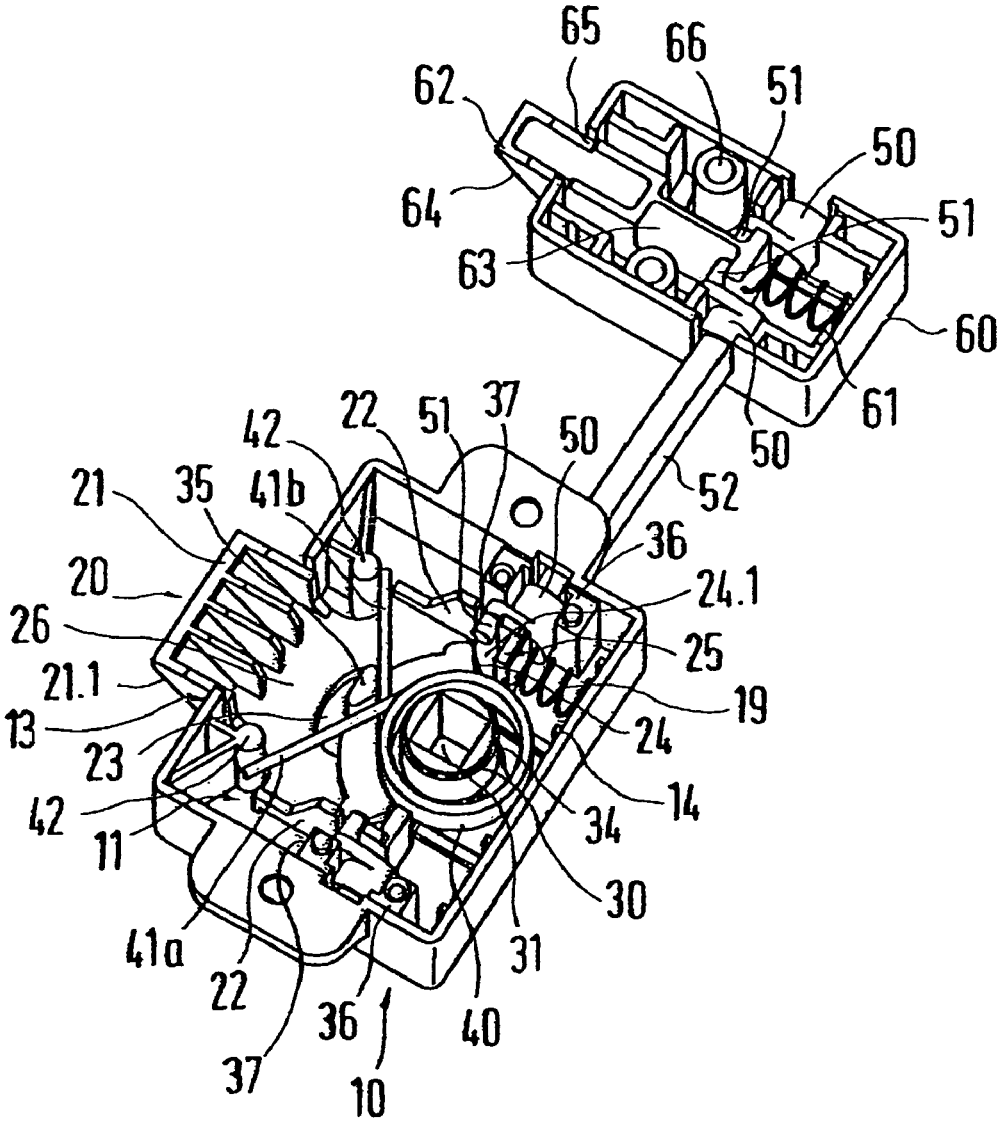
FIG. 3 shows the lock with a bolt arrangement, in a perspective view.

Such a spring element 40 is represented in FIGS. 2 and 3. The lock represented in these drawings is substantially identical in construction and function with the lock represented in FIGS. 1 and 2. The differences and the increased lock functionalities will now be addressed in greater detail.

Figure 4:
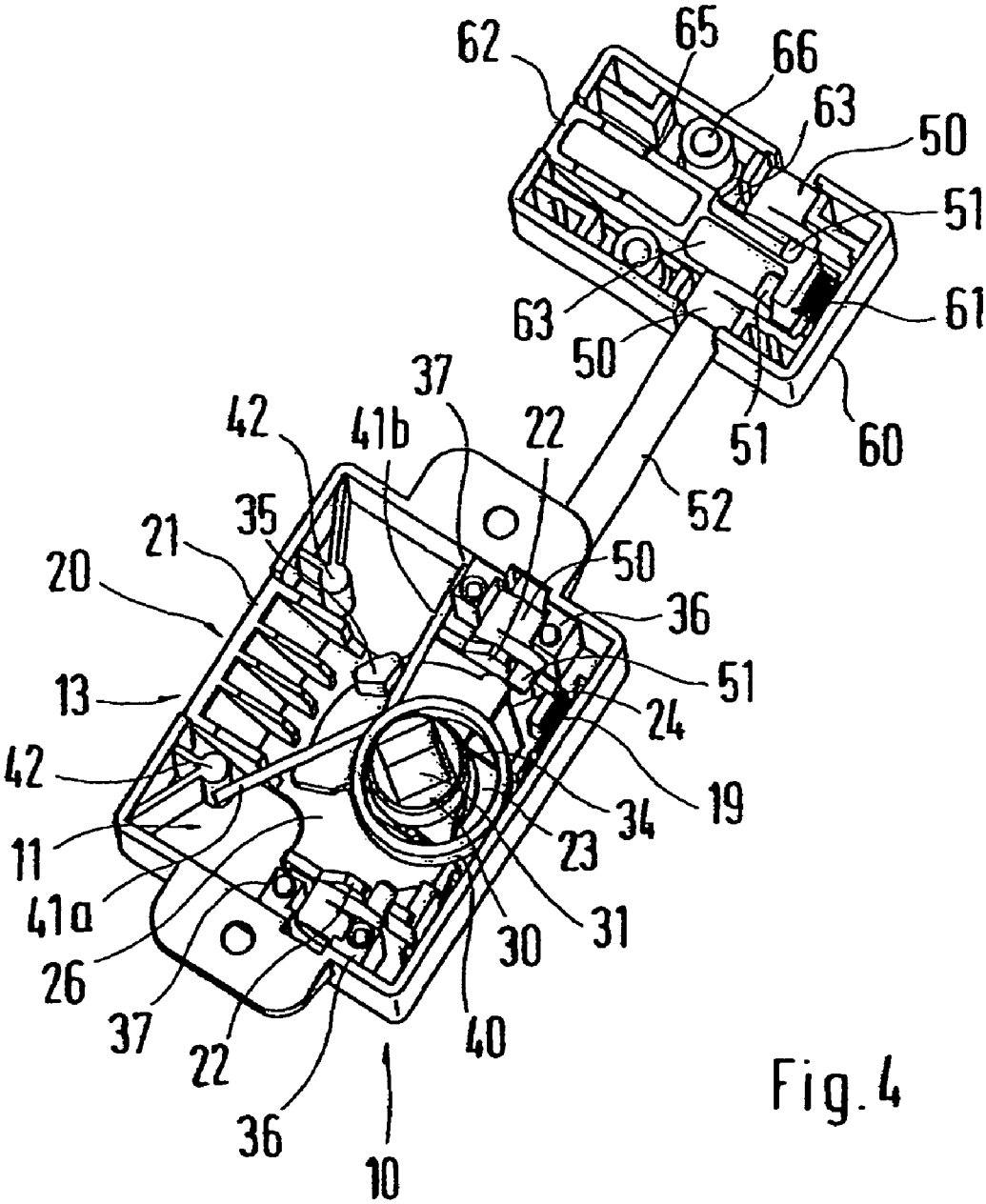
FIG. 4 shows a perspective view of the arrangement in accordance with FIG. 3, but in a changed locking position.

The spring element 40 is designed as a torsion spring and has two spring arms 41 a and 41 b which are supported, spring-loaded, in the area of or near their free ends on stops 42 of the housing 10. The two spring arms 41*a*, 41*b* are arranged at an angle with respect to each other and cross. A shoulder 35 of the follower 30 is arranged in the area of or near the crossing point. In the locked position represented in FIG. 3, the shoulder 35 rests against one or both spring arms 41*a*, 41*b*, so that the follower is maintained in the position shown. If the follower 30 is rotated for changing the lock from the locked into the opened position, the shoulder 35 moves one of the two spring arms 41*a*, 42, regardless of the direction of rotation of the follower 30, from the initial position represented in FIG. 3. In the process, the respective spring arm 41*a*, 41*b* is lifted by the associated stop 42 as shown in FIG. 4. The spring element 40 is then tensed until the spring arm 41*a*, 41*b* limits the rotating movement of the follower 30 at a stop 37 fixed on the housing. The lock position is represented in FIG. 4. In this case, the bolt 20 is completely retracted into the housing 10. If now the follower 30 is released by the handle, it is automatically displaced again by the effects of the spring element 40 into the return position represented in FIG. 3.

As FIG. 3 shows, the bolt 30 is supported opposite the opening direction by a spring element 19, the same as the lock in accordance with FIGS. 1 and 2, so that it is maintained free of play in the locking position.

The functionality of the lock represented in FIGS. 3 and 4 can be increased by a revolving rod mechanism. For this purpose, a respective drive element 50 is rotatably maintained in two bearing receivers 36 of the housing 10. In this case, the axis of rotation of the drive element 50 extends in a plane perpendicular with respect to the axis of rotation 27 of the follower 20. With a pusher 51 the drive elements 50 engage a slit-shaped receiver cut into the shoulder 22 of the bolt 20. In this way, the pushers 51 can be shifted when the bolt 20 is displaced. Because the pushers 51 are arranged eccentrically with respect to the axes of rotation of the drive elements 50, the translation movement of the bolt 20 can be converted into a rotary movement of the drive element 50.

The drive elements 51 have plug-in receivers, which are accessible through an opening in the housing 10. A revolving rod 52, which is not circular in cross section, can be inserted into it.

A bolt arrangement can be coupled, facing away from the lock, with the revolving rod 52. This arrangement has a bolt 62, which can be linearly displaced between an opened position and a locked position. This can be displaced in guide devices of a bolt housing 60. The bolt 62 is maintained under prestress in the position shown in FIG. 3 by a spring element 61 and can be inserted into the bolt housing 60 against the spring force.

The bolt 62 has receptacles 63 on its side, which are engaged by the pushers 51 of drive elements 50. The drive elements 50 are identical to the previously mentioned drive elements 50 inserted into the lock housing 10 and are rotatably housed in bearings of the lock housing 10. The revolving rod 52 is coupled with one of the two drive elements 50. The second drive element 50 can be used when the bolt arrangement is inserted on the oppositely located side of the lock, or if each of the two drive elements 50 maintained in the housing 10 is to each drive a revolving rod 52. In that case, structurally identical bolt arrangements can be used.

As the drawings of FIGS. 3 and 4 further show, the bolt 62 has an oblique deflection element 64 which has the same function as the bolt 20. The bolt housing 60 can be closed by a cover which can also be used as a guide device for the bolt 62 and limits its displacement by a stop 65.

The bolt arrangement can be changed from the locking state represented in FIG. 3 into the open state in accordance with FIG. 4 by the revolving rod 52. During this, the pusher 51 retracts the bolt into the bolt housing 60. As described above, when the follower 30 is relaxed, the follower, and at the same time the bolt 20, are moved back into the initial position. During this the revolving rod 62 is also rotated back and the bolt 62 is released and can then be moved back into its initial position shown in FIG. 1 by the spring element 61.

The invention claimed is:

1. A lock for doors which are hinged on a right or a left, having a follower (30) contained in a housing (10) and displaceable from an outside by an actuating element, by which a first bolt (20) is moveable by a displacement member between a locking position in which the first bolt (20) is pushed out of the housing (10), and an opened position in which the first bolt (20) is pushed into the housing (10), wherein the first bolt (20) is maintained in the locking position by a prestress of a spring (19), and wherein the follower (30) is selectively adjustable in a clockwise direction or a counterclockwise direction when the first bolt (20) is pushed out and in the locked position, to put the first bolt (20) into the opened position, the lock comprising:

one of the first bolt (20) and the follower (30) are one of directly coupled and indirectly coupled to a bolt arrangement by a revolving rod (52), with the revolving rod (52) a second bolt (62) is adjustable by a drive element (50) which is coupled with the revolving rod (52), the second bolt (62) is maintained in the locking position in a bolt housing (60) with a second prestress provided by a spring element (61), the second bolt (62) is displaceable against the second prestress by the drive element (50), and the displacement member of the follower (30) has two actuating members (32) resting against respective control cams (24) of the first bolt (20) and are supported under prestress by the spring (19) in the locked position of the first bolt (20).

2. The lock in accordance with claim 1, wherein the spring (19) maintains the first bolt (20) in a prestressed position against the actuating members (32) used as stops.

3. The lock in accordance with claim 2, wherein the two control cams (24) are symmetrically arranged with respect to a plane defined by an extension direction of the first bolt (20) and an axis of rotation of the follower (30).

4. The lock in accordance with claim 3, wherein the housing (10) has a spring receptacle (14) into which the spring (19) is insertable in a first prestressed position, and the firs bolt (20) has a pusher (25) which maintains the spring (19) in a second prestress position associated with the locking position.

5. The lock in accordance with claim 4, wherein with the first bolt (20) pushed into the housing (10) the follower (30) is supported on a spring element.

6. The lock in accordance with claim 5, wherein one of the first bolt (20) and the follower (30) drives with the revolving rod (52).

7. The lock in accordance with claim 1, wherein the two control cams (24) are symmetrically arranged with respect to a plane defined by an extension direction of the first bolt (20) and an axis of rotation of the follower (30).

8. The lock in accordance with claim 1, wherein the housing (10) has a spring receptacle (14) into which the spring (19) is insertable in a first prestressed position, and the first bolt (20) has a pusher (25) which maintains the spring (19) in a second prestress position associated with the locking position.

9. The lock in accordance with claim 1, wherein with the first bolt (20) pushed into the housing (10) the follower (30) is supported on a spring element.

10. The lock in accordance with claim 1, wherein one of the first bolt (20) and the follower (30) drives with the revolving rod (52).

* * * * *